US010482796B2

(12) United States Patent
Kobayashi

(10) Patent No.: US 10,482,796 B2
(45) Date of Patent: Nov. 19, 2019

(54) SHEET STRETCHING DEVICE

(71) Applicants: Fumito Kobayashi, Tokyo (JP); RIDEAWORKS Inc., Tokyo (JP)

(72) Inventor: Fumito Kobayashi, Tokyo (JP)

(73) Assignees: RIDEAWORKS INC., Tokyo (JP); Fumito Kobayashi, Tokyo (JP)

( * ) Notice: Subject to any disclaimer, the term of this patent is extended or adjusted under 35 U.S.C. 154(b) by 0 days.

(21) Appl. No.: 15/576,033

(22) PCT Filed: Jul. 27, 2016

(86) PCT No.: PCT/JP2016/072087
§ 371 (c)(1),
(2) Date: Nov. 21, 2017

(87) PCT Pub. No.: WO2017/018469
PCT Pub. Date: Feb. 2, 2017

(65) Prior Publication Data

US 2018/0158379 A1 Jun. 7, 2018

(30) Foreign Application Priority Data

Jul. 30, 2015 (JP) ..... 2015-151037

(51) Int. Cl.
*G09F 7/18* (2006.01)
*G09F 15/00* (2006.01)

(52) U.S. Cl.
CPC ..... *G09F 7/18* (2013.01); *G09F 15/00* (2013.01); *G09F 2015/0093* (2013.01)

(58) Field of Classification Search
CPC ..... E06B 3/80; G09F 7/18; G09F 2007/1821; G09F 2007/1843; G09F 2007/1886;
(Continued)

(56) References Cited

U.S. PATENT DOCUMENTS 2,835,325 A * 5/1958 Gilbert ..... E06B 9/52 16/273
3,822,734 A * 7/1974 Tombu ..... F16B 2/20 160/383

(Continued)

FOREIGN PATENT DOCUMENTS

EP 0548691 A1 6/1993
JP 06051704 A * 2/1994

(Continued)

OTHER PUBLICATIONS

International Search Report and Written Opinion, International Patent Application No. PCT/JP2016/072087, dated Sep. 6, 2016, with English translation of Search Report (4 pages).

(Continued)

*Primary Examiner* — Daniel P Cahn
(74) *Attorney, Agent, or Firm* — Hamre, Schumann, Mueller & Larson, P.C.

(57) ABSTRACT

A sheet stretching device is provided which is capable of preventing a sheet from being slacked, with the sheet stretched over a frame, by possibly preventing unnecessary motions of a retaining member for fixedly drawing the sheet into the frame.

A retaining groove (2*a*) is formed along the length direction of the frame on the front surface side of a frame (2). Retaining plates (4), with a rectangular cross section, to be fitted into the retaining groove are attached to the peripheral edge portion of a sheet (3). The retaining plate is formed of an elastic material and substantially equal in thickness to the width of the retaining groove. A plurality of projections (4*a*) at certain intervals in the depth direction of the retaining groove are formed on at least one of the inner wall surface of the retaining groove and the side surface of the retaining plate.

6 Claims, 9 Drawing Sheets

(58) Field of Classification Search
CPC ..... G09F 2007/1891; G09F 15/0031; G09F 2015/0093; G09F 15/0012; G09F 15/0025; B44C 7/022; E04F 13/005; Y10S 24/45
USPC ..... 160/394
See application file for complete search history.

(56) References Cited

U.S. PATENT DOCUMENTS 3,885,335 A * 5/1975 Egermayer ..... G09F 1/12 40/603
3,928,897 A * 12/1975 Tombu ..... B44C 7/022 160/327
4,552,406 A * 11/1985 Ohl ..... A47C 5/04 160/394
4,662,038 A * 5/1987 Walker ..... F16B 5/0692 160/392
4,731,960 A * 3/1988 Sease ..... B44C 7/022 160/392
4,788,806 A * 12/1988 Sease ..... B44C 7/022 160/395
4,920,714 A * 5/1990 Sease ..... B44C 7/022 160/392
4,986,332 A * 1/1991 Lanuza ..... B44C 7/022 160/327
5,007,188 A * 4/1991 Feist ..... B44C 5/02 160/371
5,015,034 A * 5/1991 Kindig ..... A47C 7/70 297/227
5,033,216 A 7/1991 Gandy et al.
5,214,892 A * 6/1993 Livingston ..... B44C 7/022 24/562
5,255,459 A * 10/1993 Verret ..... G09F 15/0025 40/563
5,398,388 A * 3/1995 Coleman ..... G09F 15/0025 24/462
5,599,446 A * 2/1997 Junker ..... B01D 25/001 210/230
5,904,200 A * 5/1999 Agen ..... E06B 9/52 160/371
6,061,941 A * 5/2000 Verret ..... G09F 15/0025 160/327
6,283,247 B1 * 9/2001 McGrath ..... B44C 7/022 181/295
6,560,827 B1 * 5/2003 Gross ..... A47C 17/84 24/265 C
7,434,534 B2 * 10/2008 Erskine ..... B63B 17/02 114/361
8,151,540 B2 * 4/2012 Paz ..... E06B 5/10 52/202
8,240,072 B2 * 8/2012 Frey ..... G09F 15/0012 40/603
9,986,845 B1 * 6/2018 Hsieh ..... F16B 2/005
2006/0242805 A1 * 11/2006 Coleman ..... F16B 5/0692 24/462
2011/0094135 A1 * 4/2011 Frey ..... G09F 7/00 40/605
2011/0185610 A1 * 8/2011 Froio ..... G09F 15/00 40/606.17
2011/0192556 A1 8/2011 Frey
2014/0345174 A1 * 11/2014 Weight ..... G09F 13/04 40/541
2016/0078790 A1 * 3/2016 Truijen ..... G09F 7/20 40/607.1
2017/0092162 A1 * 3/2017 Skarvellis ..... G09F 7/18
2017/0198480 A1 * 7/2017 Park ..... E04F 13/005
2018/0251974 A1 * 9/2018 Beille ..... E04B 2/7416

FOREIGN PATENT DOCUMENTS

JP 2007-327257 A 12/2007
JP 2009-063853 A 3/2009
JP 2009063853 A * 3/2009
JP 3200381 U 10/2015
KR 20-0465700 3/2013
WO 9427273 A1 11/1994

OTHER PUBLICATIONS

Extended European Search Report, dated Feb. 21, 2019 (Feb. 21, 2019), for related European Application No. EP16830574.6 (pp. 10).

* cited by examiner

SHEET STRETCHING DEVICE

TECHNICAL FIELD

The present invention relates to a sheet stretching device which is used to attach a sheet to a frame so as to cover a portion surrounded by the frame.

BACKGROUND ART

In general, a sheet with logos or ads printed thereon, a plain sheet, a cloth sheet, or a decorative pattern sheet is attached to a frame so as to cover a portion surrounded by the frame, thereby serving as a panel-shaped display or an indoor partition.

Then, to attach the sheet to the frame, the frame is provided with a retaining groove formed in the length direction of the frame, and then covered with the sheet over the retaining groove. After that, a retaining member that has been brought into contact with a surface of the sheet is pushed into the retaining groove in conjunction with the sheet. This allows the peripheral edge portion of the sheet to be sandwiched between the inner surface of the retaining groove and the retaining member, and the sheet to be thereby fixed to the frame.

Furthermore, for example, as disclosed in Patent Literature 1, the retaining member is fixedly attached to the rear surface side of the sheet by thermal fusion or adhesion, and then the retaining member is pushed into the retaining groove of the frame, thereby securing the sheet to the frame.

In this technique, the peripheral edge portion of the sheet covers the retaining groove and the retaining member that has been pushed into the retaining groove.

As a result, unnecessary members are never exposed from the peripheral edge portion of the sheet, thus maintaining the design effects applied to the sheet.

CITATION LIST

Patent Literature

Patent Literature 1: Japanese Patent Application Laid-Open No. 2007-327257

SUMMARY OF INVENTION

Technical Problem

In the conventional technique mentioned above, the following problems that are to be improved are remained unaddressed.

That is, the sheet is secured to the retaining member by adhesion or thermal fusion. However, in the former case, it is expected that the adhesive force may not withstand the tension caused by the sheet being stretched, and in the latter case, the device may be increased in size and thus invite an increase in manufacturing costs.

Furthermore, the friction between the retaining member and the retaining groove is employed to support the tension given to the sheet to stretch the sheet. However, the following problems may be expected due to the fact that the retaining member is circular in cross section.

When the tension given to the sheet acts on the retaining member, the tension serves to rotate the retaining member, and this rotation in turn causes the retaining member to move toward the opening of the retaining groove, thereby reducing the tension.

The reduction in the tension given to the sheet will result in the sheet being slacked and wrinkled.

Then, the sheet wrinkled may cause the design applied to the sheet to be distorted, impairing the primary effects of the design.

The present invention was developed in view of the problems remained unaddressed in the conventional technique mentioned above. It is therefore the problem to be addressed by the invention to provide a sheet stretching device which is capable of preventing a sheet from being slacked, with the sheet stretched over a frame, while possibly preventing unnecessary motions of a retaining member for fixedly drawing the sheet into the retaining groove.

Solution to Problem

A sheet stretching device of the present invention attaches a sheet to a frame over a portion surrounded by the frame. The sheet stretching device is characterized in that a retaining groove is formed along a length direction thereof on a front surface side of the frame; a retaining plate, with a rectangular cross section, to be fitted into the retaining groove is attached to a peripheral edge portion of the sheet; the retaining plate is formed of an elastic material and substantially equal in thickness to a width of the retaining groove; a plurality of projections are formed, at certain intervals in a depth direction of the retaining groove, on a side surface of the retaining plate opposite to a side surface to which the sheet has been attached; and with the retaining plates that are parallel to each other and fitted into the retaining grooves that oppose in parallel to each other, a distance between portions of the retaining plates protruded from the retaining grooves is substantially equal to or less than a distance between the retaining grooves.

With the sheet stretched, such a configuration allows the retaining plate and the retaining groove to be brought into contact with each other via the plurality of projections.

Here, since the plurality of projections are formed at certain intervals in the depth direction of the retaining groove, the retaining plate is supported in the retaining groove at a plurality of points at certain intervals in the depth direction.

As a result, the tension of the sheet acting on the retaining plate prevents the retaining plate to be rotated and provides the retaining plate with a great frictional force in the depth direction of the retaining groove.

These synergistic effects constrain unnecessary motions of the retaining plate and prevent the tension of the stretched sheet from being slacked.

Thus, the design applied to the sheet is prevented from being distorted, thus preventing the effects of the design from being impaired.

The retaining plate is preferably attached to the rear surface side of the sheet.

With the retaining plate fitted in the retaining groove to stretch the sheet, such a configuration allows the retaining groove and retaining plate to be covered with the sheet and thereby hidden.

This enables the peripheral edge portion of the sheet to be accommodated in a visually simplified manner and enhance the entire design property including the frame when the sheet is stretched.

On the other hand, as described above, since the retaining plate is effectively retained in the retaining groove, the retaining plate can be retained with part thereof protruded from the retaining groove.

Here, to stretch the sheet, the retaining plates have to be fitted into the respective retaining grooves that are spaced from each other.

Then, to impart adequate tension to the stretched sheet, the distance between the retaining plates to be fitted into the retaining grooves has to be less than the distance of the retaining groove sweat.

When such a size is set, as described above, the end portion of the retaining plate to which the sheet is connected is to be located at an inner position than the retaining groove. However, this difference in distance is allowed by the elasticity of the protruded portion of the retaining plate, by part of the retaining plate being retained as protruded from the retaining groove.

Furthermore, when the tension imparted to the sheet is reduced, for example, due to the elongation of the sheet after stretched, the protruded portion of the retaining plate can be pushed into the retaining groove, thereby widening the distance between the retaining plates so as to recover the tension of the sheet.

It is thus possible to impart an adequate tension to the sheet to thereby prevent a slack thereof.

It is also possible to form, inside the retaining plate, a through hole along the length direction thereof.

Such a configuration can enhance the flexibility of the retaining groove in the width direction while preventing the distortion of the retaining plate in the depth direction of the retaining groove.

Thus, as described above, with the retaining plate projected from the retaining groove, the retaining plate is easily elastically deformed to facilitate accommodation of the size difference mentioned above.

Or alternatively, the accommodation range can be widened.

Then, the frame can be formed in a polygonal shape or circular shape, so that as the frame approaches a circular shape, the sheet can be more effectively stretched by reducing the length of the retaining plate.

Advantageous Effects of Invention

According to the present invention, when the retaining plate attached to a sheet is fitted into the retaining groove formed in the frame to thereby stretch the sheet, unnecessary motions of the retaining plate relative to the retaining groove can be reduced to appropriately maintain the tension given to the sheet. This prevents the sheet from being slacked, and the design of the sheet can be secured.

DESCRIPTION OF EMBODIMENTS

Figure 1:
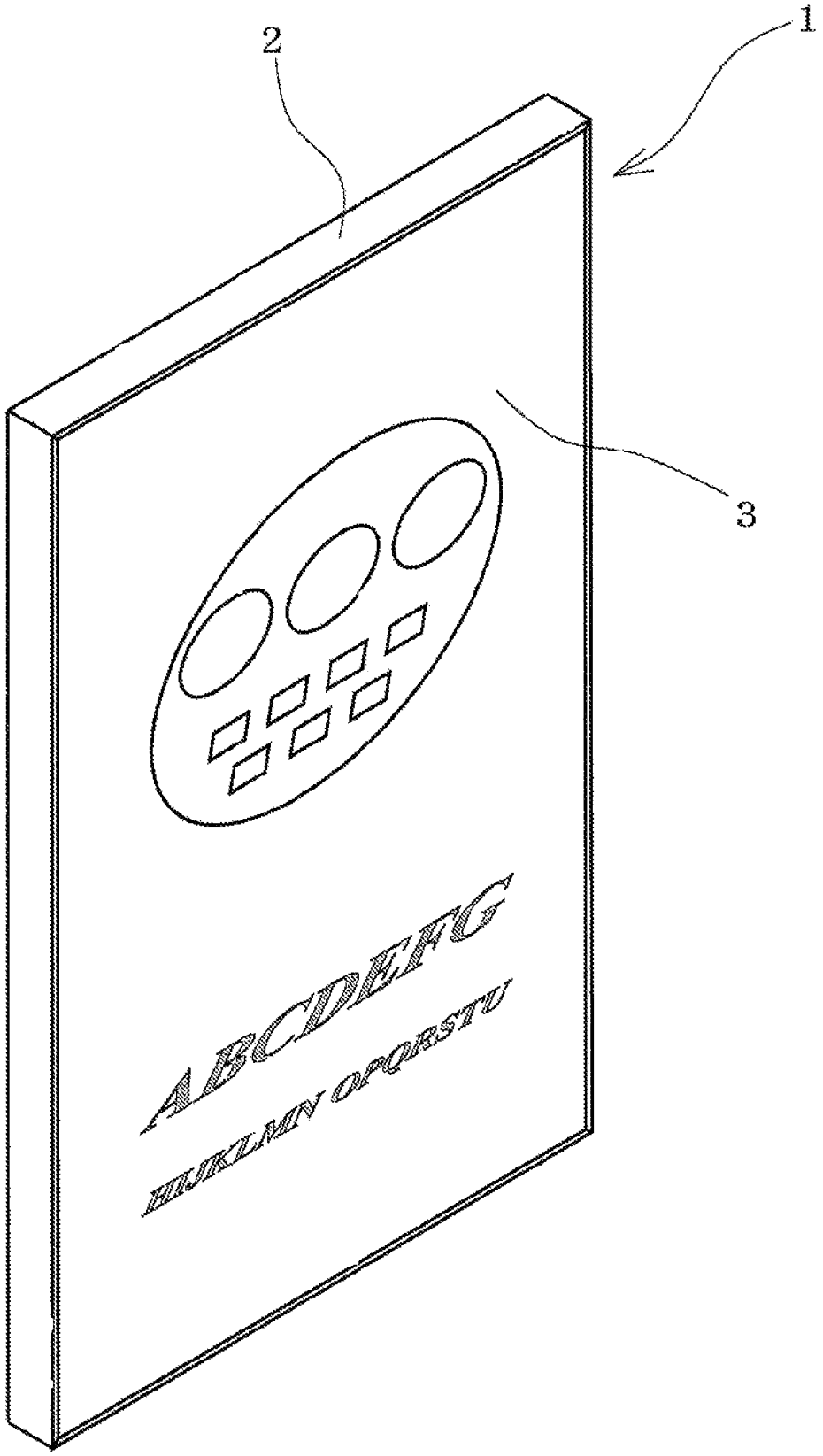
FIG. 1 is a perspective view illustrating an outer appearance of a first embodiment of the present invention.

A description will next be given of a first embodiment of the present invention with reference to the drawings.

In the figures, reference numeral 1 denotes a billboard to which this embodiment is applied and which is provided with a rectangular frame 2, and a sheet 3 that is stretched across the front surface of the frame 2 so as to cover a portion surrounded by the frame.

Figure 2:
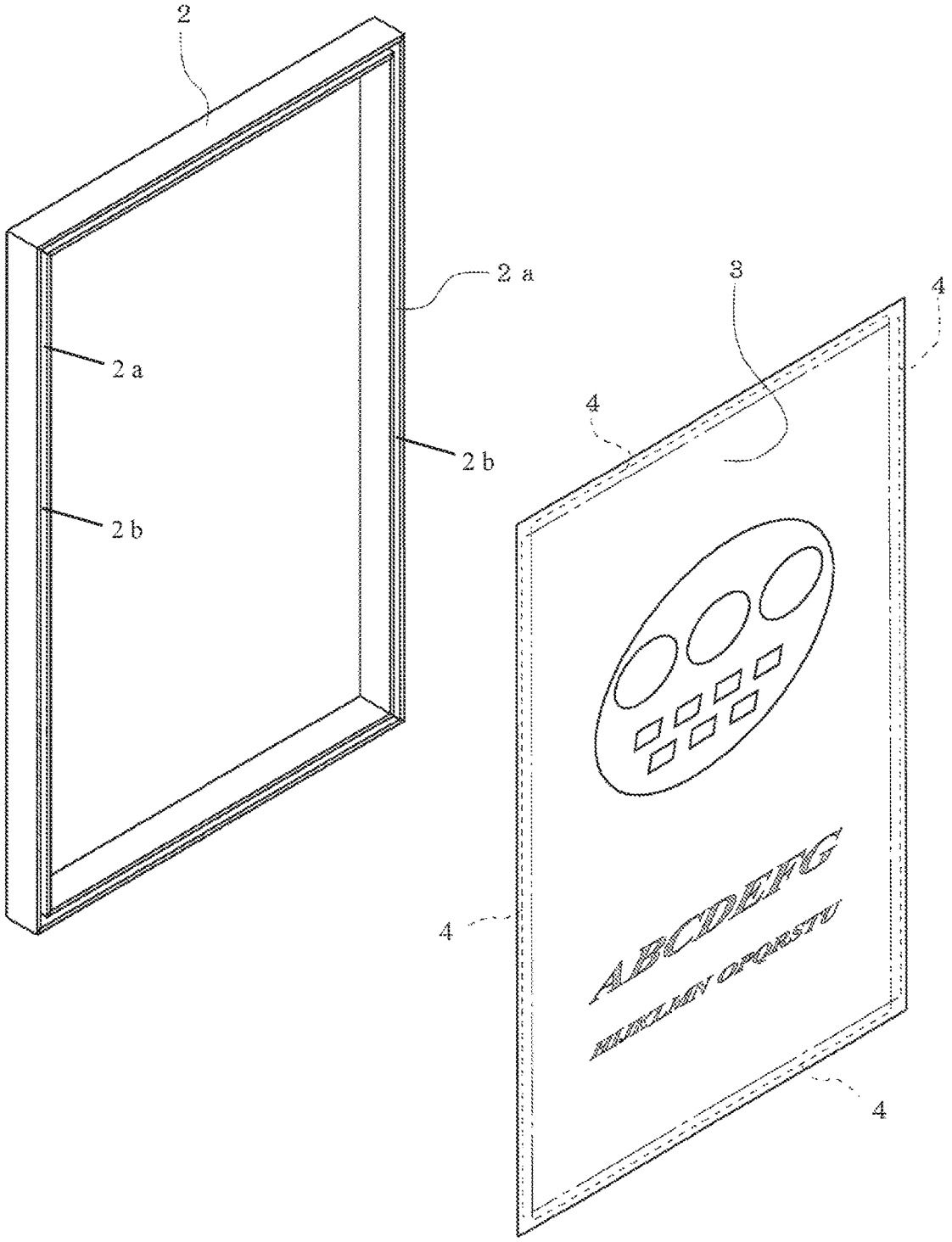
FIG. 2 is an exploded perspective view of the first embodiment of the present invention.
Figure 6:
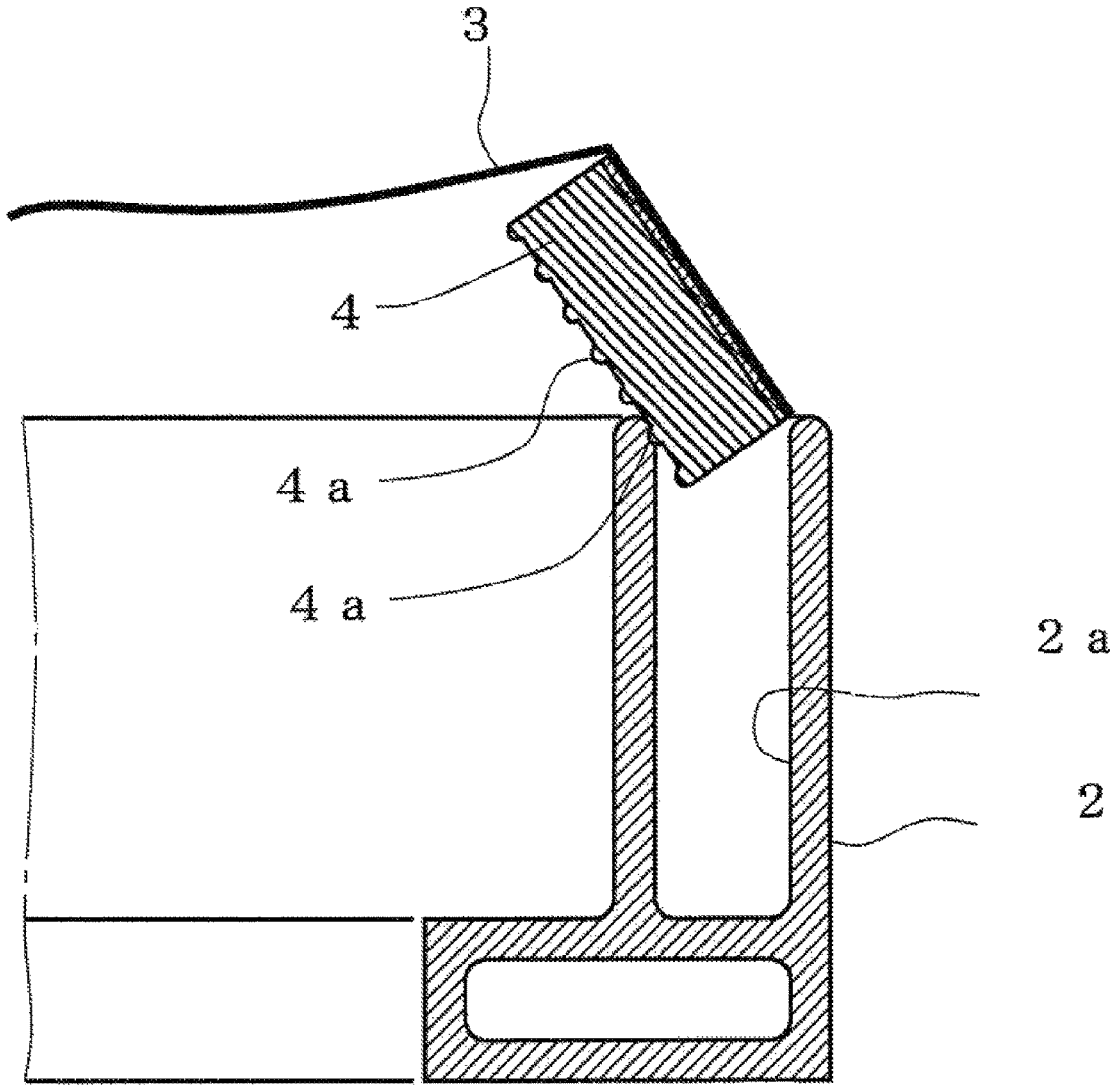
FIG. 6 is an enlarged cross-sectional view illustrating a main portion in the procedure of stretching a sheet according to the first embodiment of the present invention.

As shown in FIG. 2, the front surface of the frame 2 is provided with a retaining groove 2*a* formed along the length direction, and as shown in FIG. 6, the retaining groove 2*a* is formed with a substantially constant width along the total length of the frame 2 and thus formed in the same rectangular shape as the frame 2.

The sheet 3 is formed of cloth or a resin film, and has similitude relations with and slightly larger in shape than the rectangular shape defined by the retaining groove 2*a*. For example, preferredly employed as the sheet 3 is a sheet with a logo or ads printed, a plain sheet, a cloth sheet, or a decorative pattern sheet.

Figure 3:
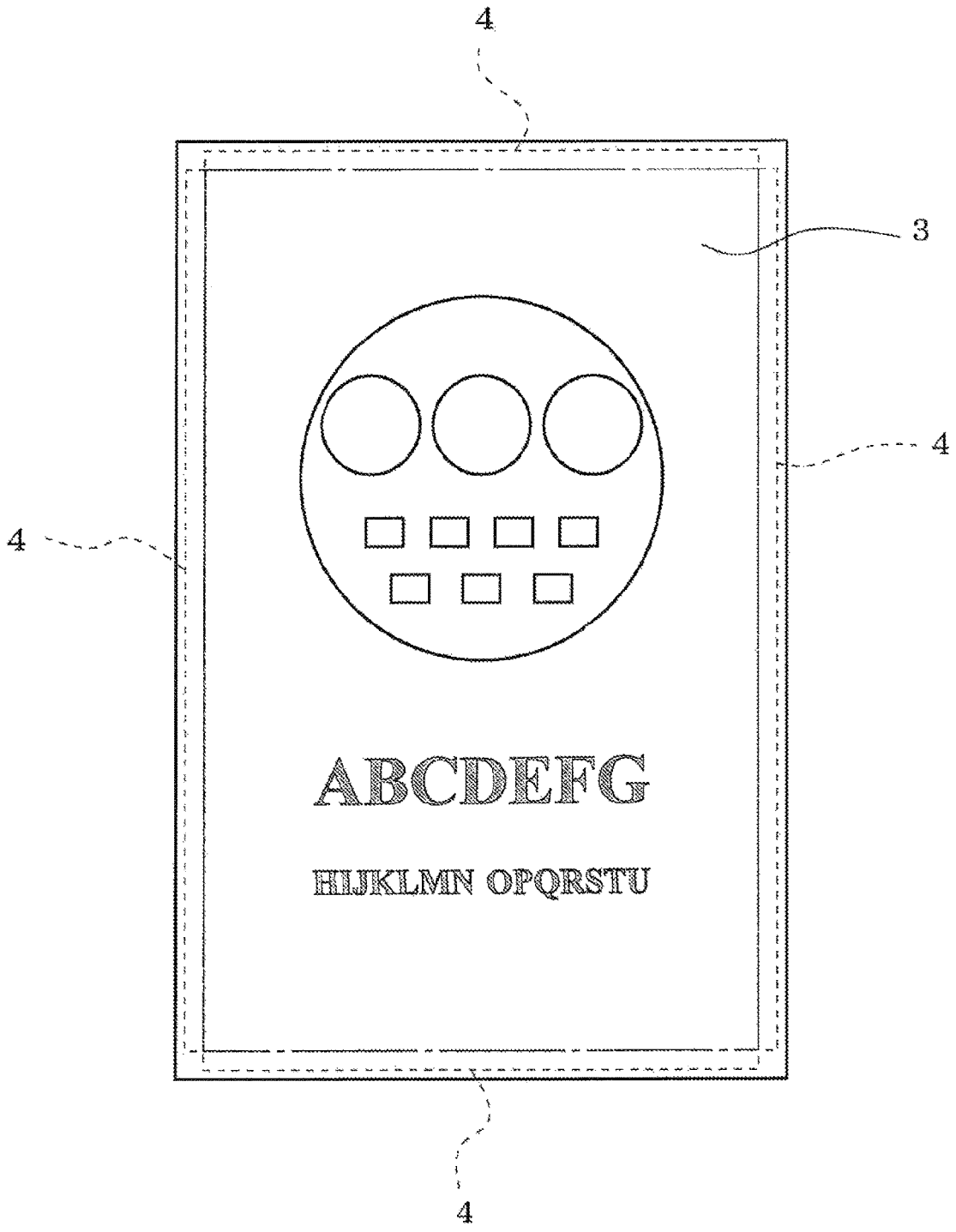
FIG. 3 is a front view illustrating a sheet of the first embodiment of the present invention.
Figure 4:
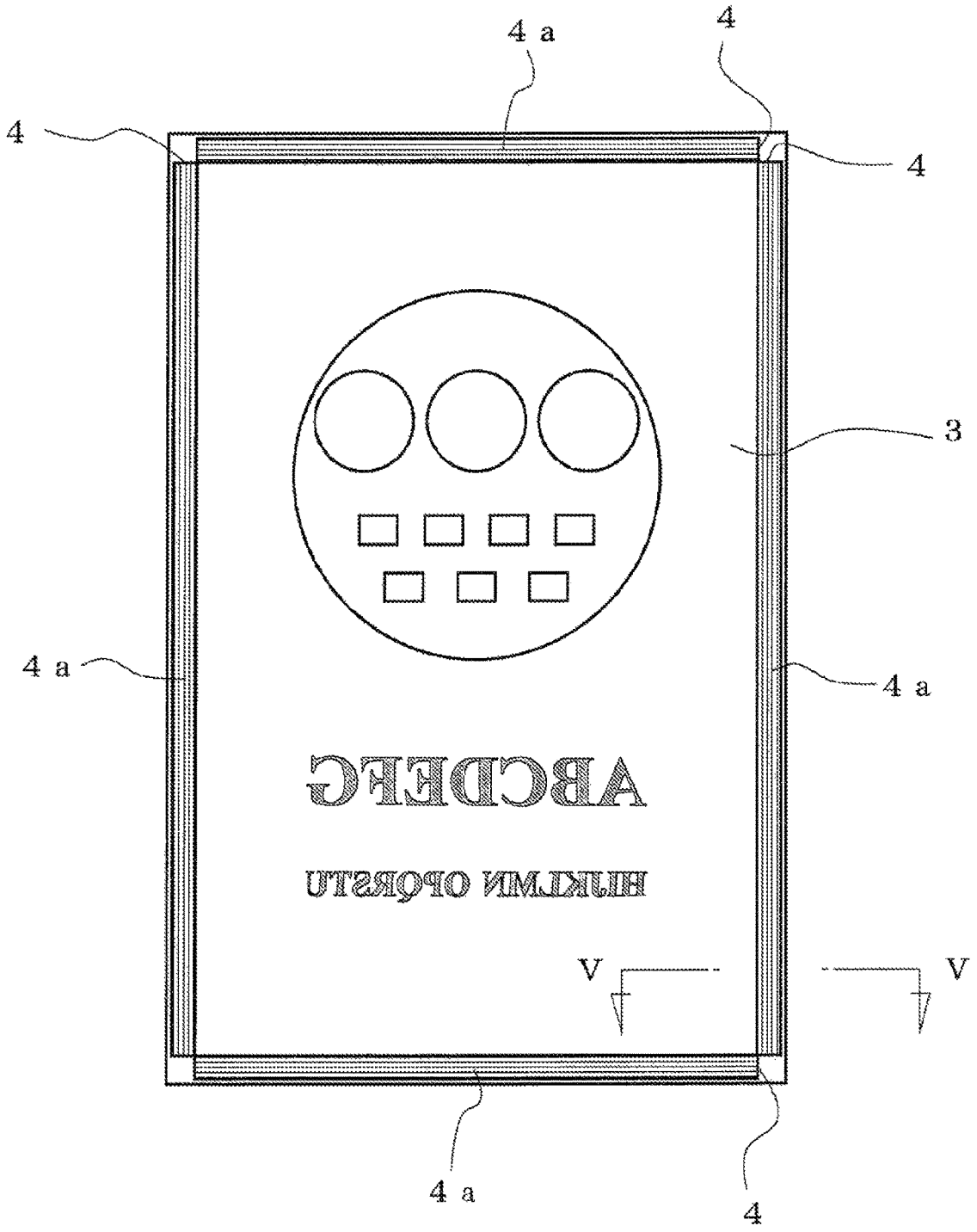
FIG. 4 is a rear view illustrating the sheet of the first embodiment of the present invention.

Then, as shown in FIG. 2 to FIG. 4, the rear surface of the sheet 3 is provided with four retaining plates 4 fixedly attached thereto along each side of the peripheral edge portion thereof.

For example, these retaining plates 4 are formed of an elastic material such as a silicone resin, and the distance between opposing parallel retaining plates 4 is set to be substantially equal to or less than the distance between opposing parallel retaining grooves 2*a* among those formed in 10 the frame 2. For example, as shown in FIG. 2, opposing retaining grooves 2*a* include parts 2*b* that are spaced apart and parallel to each other. Two of the retaining plates 4 provided along opposite edge portions of the sheet 3 are inserted into the parts 2*b* of retaining grooves 2*a*. For example, the retaining plates 4 can be formed of cardboard, corrugated cardboard, or foam materials.

Figure 5:
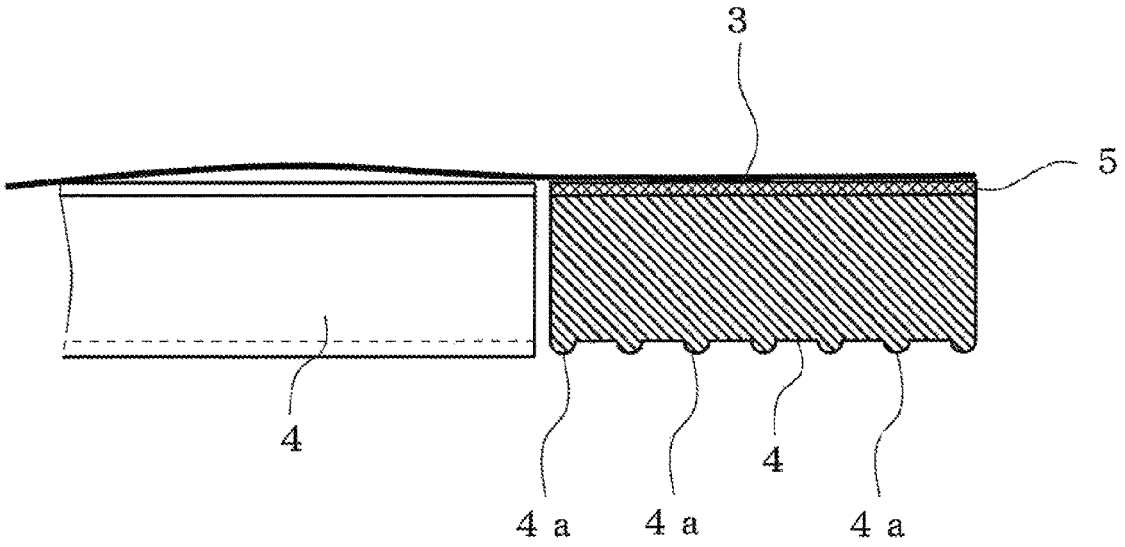
FIG. 5 is an enlarged cross-sectional view, taken along line V-V of FIG. 4, illustrating the first embodiment of the present invention.

Furthermore, the thickness of each of the retaining plates 4 is substantially the same as the width of the retaining groove 2*a*, and as shown in FIG. 5, a plurality of projections 4*a* at certain intervals in the width direction (the right-and-left direction in FIG. 5) are formed on one side in the thickness direction.

As shown in FIG. 5, on the side on which no projections 4*a* are formed, such retaining plates 4 are fixedly attached to the peripheral edge portion of the sheet 3 with an adhesive 5 such as double-sided tape.

Note that methods for attaching the sheet 3 to the retaining plates 4 are conceivable to include, in addition to sewing, a method using a stapler, a method utilizing adhering, fusing, or melting, and a method using a structural function for sandwiching the plate.

Next, referring to FIGS. 6 and 7, a description will be given of the steps of stretching the sheet 3 over the frame 2 according to this embodiment that is configured as described above.

First, as shown in FIG. 6, the peripheral edge portion of the sheet 3 is bent so that the retaining plate 4 is located on the rear surface side, and then the retaining plate 4 is inserted into the retaining groove 2*a* of the frame 2.

Figure 7:
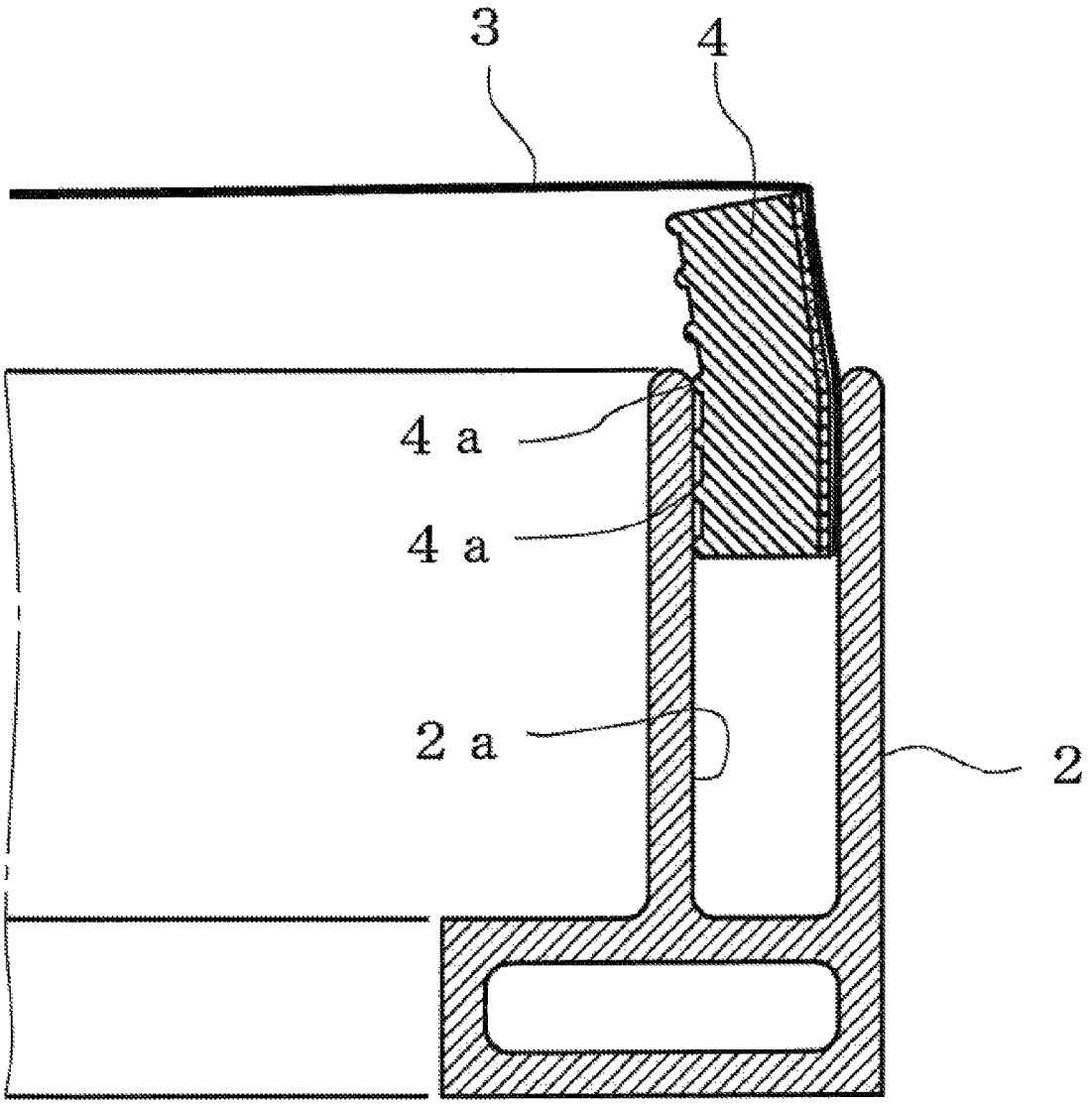
FIG. 7 is an enlarged cross-sectional view illustrating the main portion in the procedure of stretching the sheet according to the first embodiment of the present invention.

Next, the retaining plate 4 is further pushed into the retaining groove 2*a* until, as shown in FIG. 7, part of the retaining plate 4 is positioned to be protruded from the retaining groove 2*a*.

Here, when the distance between the retaining plates 4 is set to be less than the distance between the retaining grooves 2*a*, the difference therebetween is accommodated by the elastic deformation of the protruded portion of the retaining plate 4 as shown in FIG. 7.

On the other hand, the portion other than the protruded portion is pushed into the retaining groove 2*a* so as to be pushed under pressure against both the inner walls of the retaining grooves 2*a*.

Here, one side surface of the retaining plate 4 is brought into contact with one inner surface of the retaining groove 2*a* in conjunction with the sheet 3, and the other side surface is brought into contact with the inner wall of the retaining groove 2*a* via the plurality of projections 4*a* at a plurality of points at certain intervals in the depth direction.

If an external force is applied in the depth direction of the retaining groove 2*a*, this configuration causes the retaining plates 4 to be moved so as to be dislodged therefrom. However, an external force in a direction other than the depth direction would cause the retaining plates 4 to hold the positions thereof.

Thus, the retaining plates 4 are secured with reliability to the position protruded from the retaining groove 2*a*, allowing the protruded portion to be held in an elastically deformed state.

This allows the sheet 3 to be stretched while being provided with tension by the elasticity of the retaining plates 4.

As a result, when stretched, the sheet 3 is normally provided with tension and prevented from being slacked, and maintains the effects of design thereof.

Figure 8:
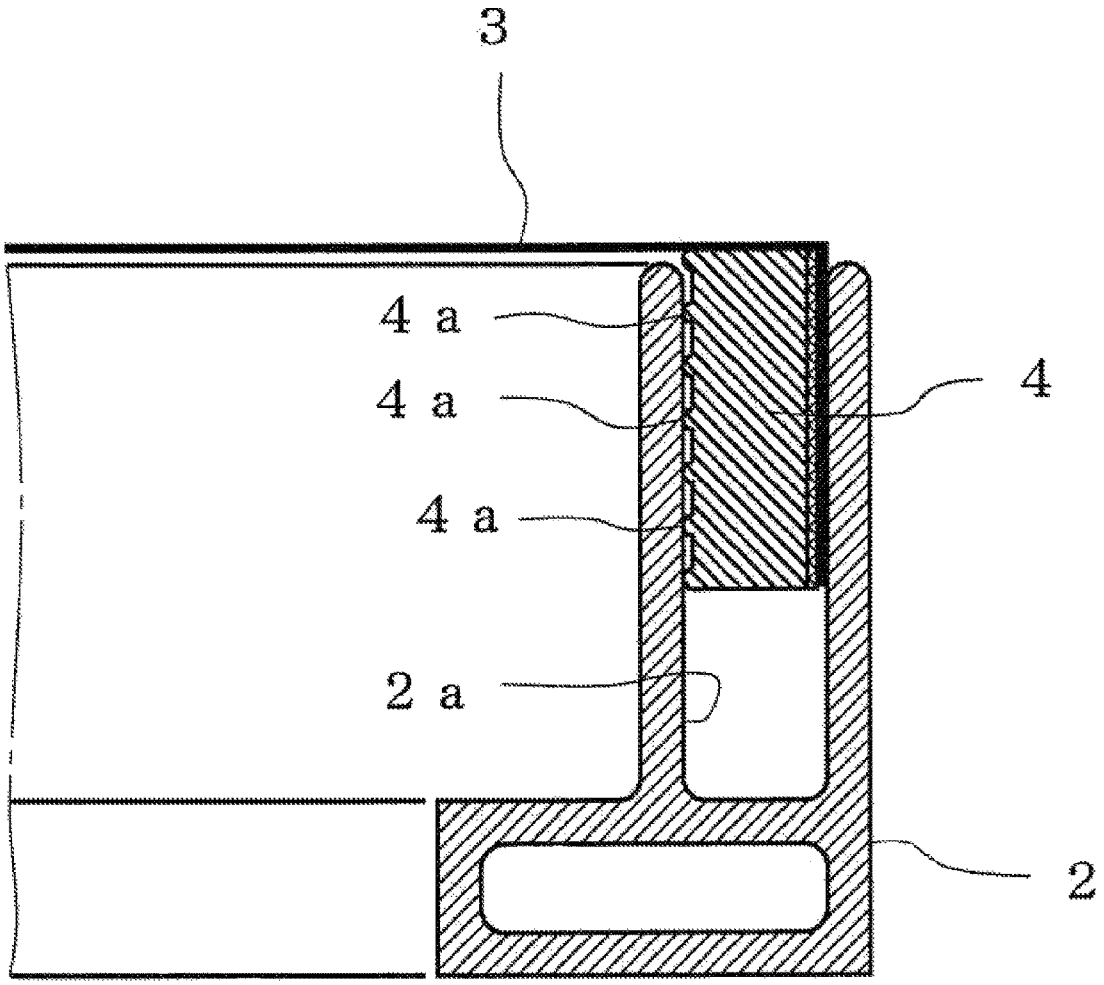
FIG. 8 is an enlarged cross-sectional view illustrating the main portion in the procedure of stretching the sheet according to the first embodiment of the present invention.

On the other hand, more tension may need to be applied to the sheet 3, for example, when the sheet 3 is slacked due to the elongation of the sheet 3. In this case, as shown in FIG. 8, this need can be satisfied by further pushing the retaining plates 4 into the retaining groove 2*a*.

Such a manipulation causes the protruded portion of the retaining plates 4 to be pushed into the retaining groove 2*a*, and thereby pushed outwardly.

As a result, the tension given to the sheet 3 is increased to thereby eliminate the slack.

Then, adjusting the position of the retaining plate 4 being pushed in enables the tension given to the sheet 3 to be adjusted, thus facilitating adjustment of the tightness of the sheet 3.

On the other hand, as described above, the retaining plates 4 are effectively prevented from being moved by an external force, such as the tension, in a direction intersecting the depth direction of the retaining groove 2*a*, but can be relatively easily moved by an external force in the depth direction of the retaining groove 2*a* because of the reduction of frictional resistance caused by the presence of the projections 4*a*.

Thus, the retaining plates 4 can be relatively easily extracted or inserted, thereby enabling replacement of the sheet 3 in a simplified manner.

Note that the various shapes and sizes of each of the components illustrated in the embodiment were shown only as an example, and thus may be modified in a variety of ways according to design requirements.

For example, in the embodiment, such an example was shown in which the projections 4*a* are formed on the retaining plate 4. However, the projections 4*a* may be formed on the inner wall of the retaining groove 2*a*, or alternatively, may also be formed on both the retaining plate 4 and the retaining groove 2*a*.

Furthermore, in the embodiment, the rectangular frame 2 was illustrated as an example. However, the frame 2 may also be formed in a triangular shape, in a polygonal shape with five or more corners, or alternatively in a circular shape.

Figure 9:
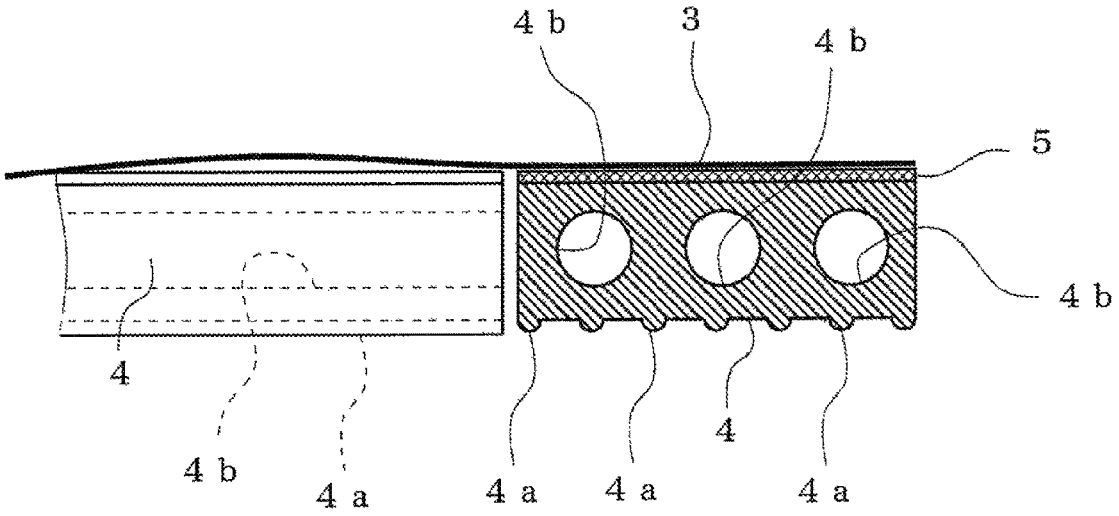
FIG. 9 is an enlarged cross-sectional view illustrating a main portion according to a modified example of the present invention.

Furthermore, as shown in FIG. 9, it is also possible to form through holes 4*b* in the retaining plate 4.

This enables fine adjustments of the tension given to the sheet 3 by reducing the elastic modulus of the retaining plate 4.

Figure 10:
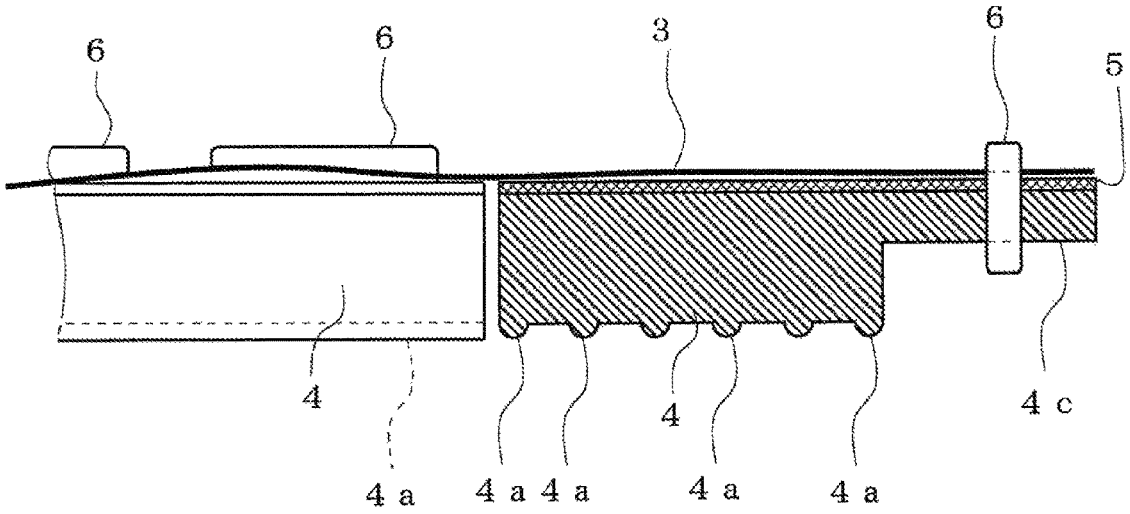
FIG. 10 is an enlarged cross-sectional view illustrating a main portion according to another modified example of the present invention.

Furthermore, as shown in FIG. 10, one side portion of the retaining plate 4 may also be provided with a reduced-thickness portion 4*c*.

Such a structure enables the retaining plate 4 and the sheet 3 to be connected to each other at the reduced-thickness portion 4*c* using a fixing member 6 such as a stapler.

That is, if the retaining plate 4 is increased in thickness when using the fixing member 6 like a stapler, the fixing member 6 will be less prone to being penetrated through the retaining plate 4, allowing the retaining plate 4 to be connected with difficulty.

In this context, forming the reduced-thickness portion 4*c* described above facilitates penetration of the fixing member 6 like the stapler to thereby enable connection with the fixing member 6.

The retaining plate 4 and the sheet 3 are connected to each other with the fixing member 6 that penetrates therethrough, thereby significantly improving the connection strength therebetween.

Note that for materials of the retaining plate 4, a plurality of materials can be used, thereby achieving cost reduction and high productivity. Examples thereof may include applying a resin to cardboards, enabling domestic sewing machines to sew cloth attached to a resin, applying a resin to cloth itself, or combining a push support vinyl chloride plate material with a foaming material.

Furthermore, in the aforementioned embodiments, such an example was illustrated in which the frame is provided with the retaining groove 2*a*, and the retaining plates 4 with the sheet 3 attached thereto are inserted into the retaining groove 2*a*, thereby stretching the sheet 3. It is also possible to employ such a structure in which the retaining groove 2*a* may be provided, for example, on a wall surface, and the retaining plates 4 with the sheet 3 attached thereto are inserted into the retaining groove on the wall surface, thereby stretching the sheet 3. Furthermore, without being limited to the wall surface, for example, it is also possible to employ such a structure in which the retaining groove 2*a* may be provided on the surface of a rectangular plate material, and the sheet 3 is stretched over the surface of the plate material.

REFERENCE SIGNS LIST

1 billboard
2 frame

2*a* retaining groove
3 sheet
4 retaining plate
4*a* projection
4*b* through hole
4*c* reduced-thickness portion
5 adhesive
6 fixing member

The invention claimed is:

1. A sheet stretching device comprising:

a frame;

a sheet;

a first retaining groove and a second retaining groove formed on a front surface side of the frame, the first retaining groove defined by an inner wall and an outer wall spaced apart by a width of the first retaining groove, the second retaining groove defined by an inner wall and an outer wall spaced apart by a width of the second retaining groove, and in each of the first retaining groove and the second retaining groove, an inner surface of the inner wall faces an inner surface of the outer wall across the width of the corresponding one of the first and second retaining grooves; and a first retaining plate fit into the first retaining groove and a second retaining plate fit into the second retaining groove, the first and second retaining plates being parallel to each other and fitted into parts of the first and second retaining grooves that are spaced apart and parallel to each other, each of the first and second retaining plates formed of an elastic material and having a rectangular cross section with a first side surface attached to a peripheral edge portion of the sheet, a second side surface opposite to the first side surface, and a thickness substantially equal to the width of the corresponding one of the first and second retaining grooves, wherein in each of the first and second retaining grooves, the first side surface of a respective one of the first and second retaining plates faces the inner surface of a respective one of the outer walls with the sheet disposed therebetween and the second side surface of the respective one of the first and second retaining plates contacts the inner surface of a respective one of the inner walls, the second side surface of one of the first and second retaining plates includes a plurality of projections formed at certain intervals in a depth direction of the corresponding one of the first and second retaining grooves, the first side surface of the one of the first and second retaining plates not including a projection, and in a state in which the first and second retaining plates are positioned to protrude from the parts of the first and second retaining grooves that are spaced apart and parallel to each other, a distance between portions of the retaining plates protruding from the retaining grooves is substantially equal to or less than a distance between the parts of the retaining grooves as a result of the elastic material compressing.

2. The sheet stretching device according to claim 1, wherein the first retaining plate is formed to be shorter than a depth of the first retaining groove, and the second retaining plate is formed to be shorter than a depth of the second retaining groove.

3. The sheet stretching device according to claim 1, wherein a through hole is formed inside each of the first and second retaining plates in a direction along a peripheral shape of the sheet.

4. The sheet stretching device according to claim 1, wherein the frame is formed in a polygonal shape.

5. The sheet stretching device according to claim 1, wherein the first and second retaining grooves are connected and form a continuous retaining groove that extends along at least one edge of the frame.

6. The sheet stretching device according to claim 1, wherein the one of the first and second retaining plates is configured to have multiple positions in a respective one of the first and second retaining grooves, the multiple positions having differing depths in the respective one of the first and second retaining grooves.

* * * * *